US005259141A

United States Patent [19]

D'Alessandro

[11] Patent Number: 5,259,141

[45] Date of Patent: Nov. 9, 1993

[54] TREE PLANTER

[76] Inventor: Frank R. D'Alessandro, 667 Waverly Ave., Holtsville, N.Y. 11742

[21] Appl. No.: 781,916

[22] Filed: Oct. 24, 1991

[51] Int. Cl.[5] ..... A47G 7/00

[52] U.S. Cl. ..... 47/39; 47/66; 248/27.8

[58] Field of Search ..... 47/39, 66; 248/27.8, 248/218.4

[56] References Cited

U.S. PATENT DOCUMENTS

| | | | |
|---|---|---|---|
| 585,486 | 6/1897 | Snow . | |
| 3,332,652 | 7/1967 | Oaks . | |
| 3,747,268 | 7/1973 | Linder . | |
| 4,083,457 | 9/1976 | Dromboski | 47/39 |
| 4,597,221 | 7/1986 | Adair et al. . | |
| 4,821,454 | 4/1989 | Wilds . | |
| 4,847,741 | 7/1989 | Boettinger . | |

FOREIGN PATENT DOCUMENTS

| | | | |
|---|---|---|---|
| 3431438 | 2/1986 | Fed. Rep. of Germany | 47/39 |
| 7322426 | 2/1975 | France | 47/39 |
| 2431826 | 7/1978 | France | 47/39 |
| 1160390 | 12/1967 | United Kingdom | 47/39 |

*Primary Examiner*—Carl D. Friedman
*Assistant Examiner*—Wynn E. Wood
*Attorney, Agent, or Firm*—Galgano & Belkin

[57] ABSTRACT

A planter for supporting a plurality of plant pots around the trunk of a tree comprising a plurality of identical, flat segments, each segment forming the arc of a circle having an opening in the middle to support a flower pot. A pair of arcuate slots are located on opposite sides of the opening, the segments overlapping each other with the arcuate slots on overlapping segments being aligned with each other and surrounding the trunk. A bolt extends through each pair of aligned slots held together by a wing nut which are locked together after sliding said overlapping segments with respect to each other to closely fit the outline of the trunk. The segments can be designed to accomodate a pole with a rectangular cross section.

8 Claims, 3 Drawing Sheets

FIG. 2
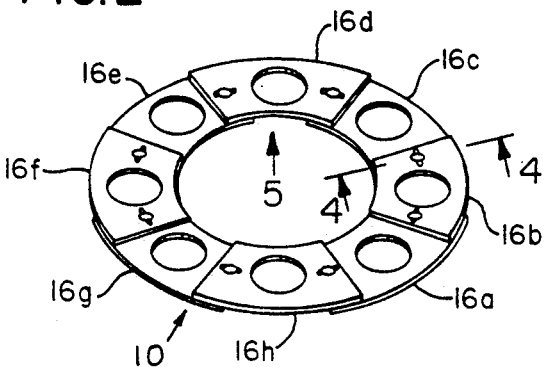
FIG. 5
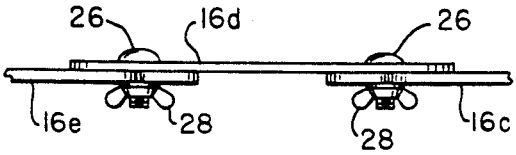
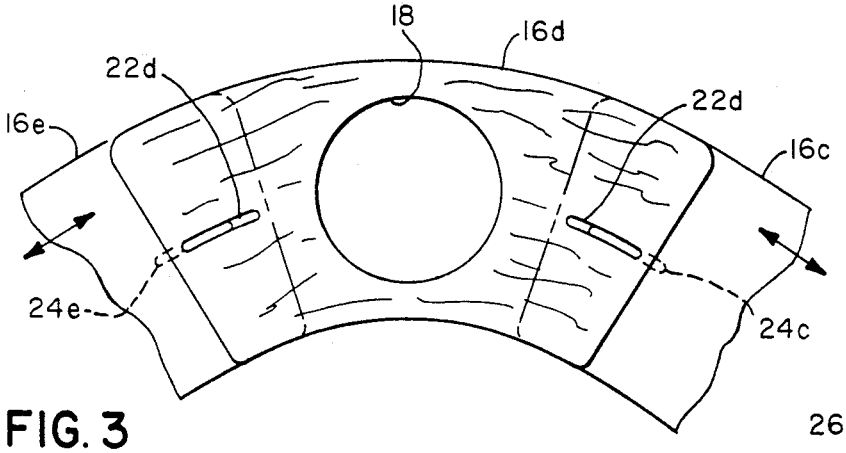
FIG. 3
FIG. 4
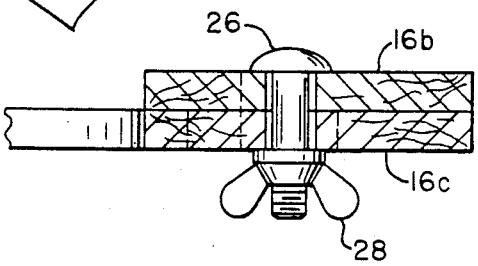
FIG. 1
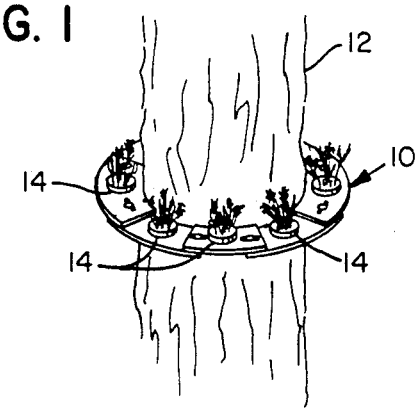
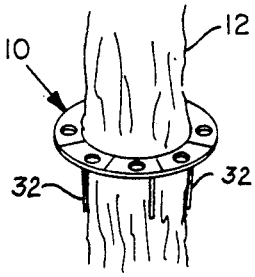
FIG. 6

FIG. 7
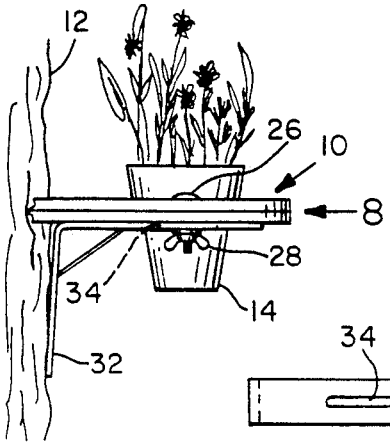
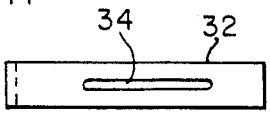
FIG. 8a
FIG. 8
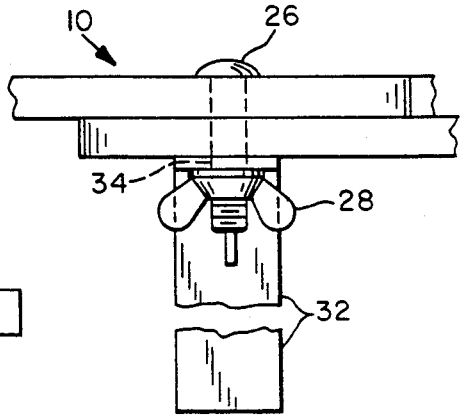
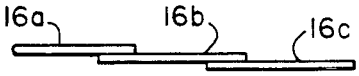
FIG. 8b
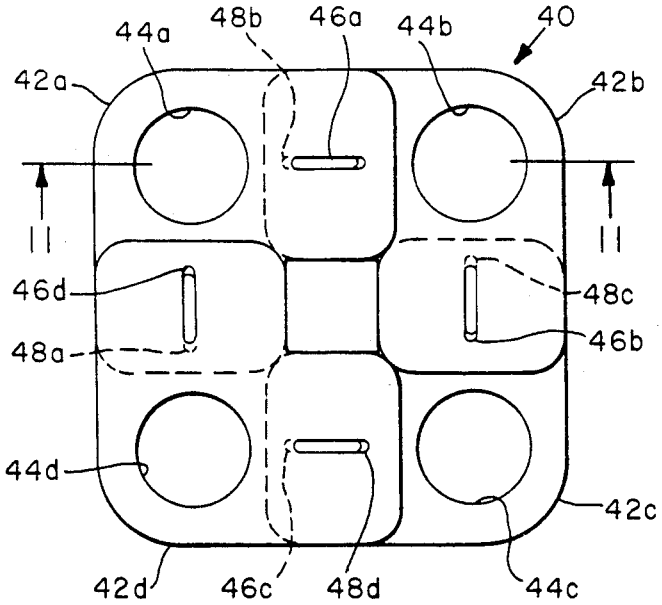
FIG. 9
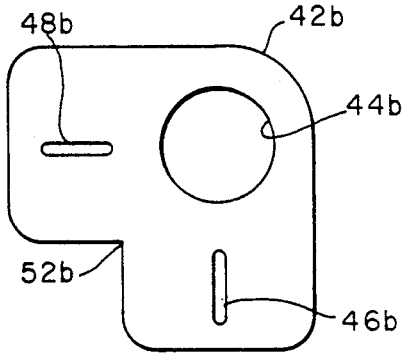
FIG. 10

FIG. 11
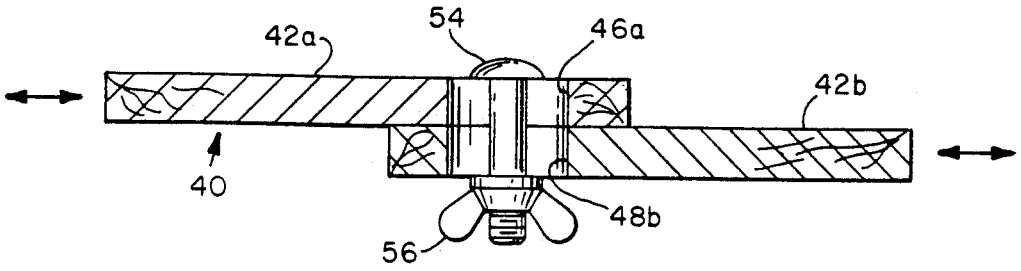
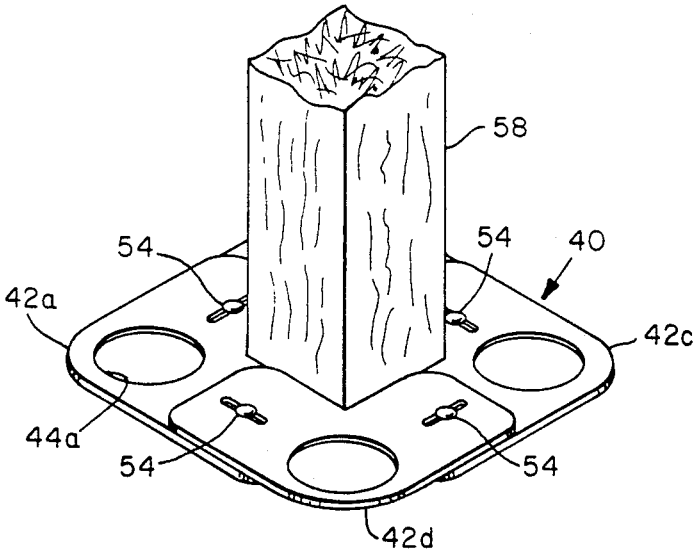
FIG. 12a
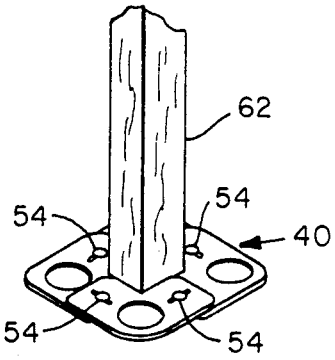
FIG. 12b

TREE PLANTER

BACKGROUND OF THE INVENTION

The present invention relates to a tree planter and more particularly to a planter for mounting potted plants around the trunk of a tree or a pole.

Planting arrangements presently in use for arranging potted plants around trees and poles are generally complicated and difficult to use. They are also expensive and lack the ability to cover adequately a range of diameters of the trees or poles.

A number of United States Patents show arrangements for supporting plantings on trees and poles.

U.S. Pat. No. 585,486 discloses a vase combined with a flag holder.

U.S. Pat. No. 3,332,652 shows apparatus for supporting a planter on parking meters.

U.S. Pat. No. 3,747,268 teaches a planter made of sections for mounting on a cylindrical post.

U.S. Pat. No. 4,597,221 discloses a plant receptacle for use with an umbrella-type table.

U.S. Pat. No. 4,821,454 teaches a floral arrangement container for use with an umbrella-type table.

U.S. Pat. No. 4,847,741 describes a planter device for being mounted on a light pole.

None of the preceding patents teaches the present invention.

SUMMARY OF THE INVENTION

This invention comprises novel apparatus for mounting flower pots and the like on trees and similar structures and overcomes or substantially avoids many of the problems and drawbacks associated with pot holders now available.

A preferred embodiment of this invention consists of overlapping, arcuate shaped segments each of which has an opening to accomodate a flower pot. The overlapping portions of the segments are provided with annularly disposed slots which permit the segments to be adjusted to accomodate a range of sizes of tree trunks. In addition, segments can be added or subtracted to extend the range of tree diameter which can be accommodated.

One of the features of this invention is that the segments are flat and simple in construction, and identical to each other so that the cost of purchasing and mounting the apparatus is less than the cost would be of arrangements now available to accomplish the same result. In addition, by adjusting the segments to fit tightly around the tree trunk, no further support is necessary except where very heavy pots are being mounted, and in that situation, a very simple support structure is available as part of this invention.

Another embodiment of this invention is designed to mount the pots on a pole or mast which is square or rectangular in cross section.

It is thus a principal object of this invention to provide a flow pot holding arrangement for use with tree trunks and similar free standing member.

Other objects and advantages of this invention will hereinafter become obvious from the following description of preferred embodiments of this invention.

BRIEF DESCRIPTION OF THE DRAWINGS

FIG. 1 is a perspective view of a preferred embodiment of this invention mounted on a tree trunk.

FIG. 2 is a perspective view of the embodiment shown in FIG. 1 showing some of the construction details of the embodiment.

FIG. 3 is a plan view of a portion of the embodiment shown in FIG. 2 with additional details being illustrated.

FIG. 4 is a section view taken along 4—4 of FIG. 2.

FIG. 5 is an elevation view taken in the direction of 5 shown in FIG. 2.

FIG. 6 is a perspective view of the apparatus with a support for use with heavy pots.

FIG. 7 is a partial elevation view of the arrangement shown in FIG. 6.

FIG. 8 is an end view in the direction of 8 shown in FIG. 7.

FIG. 8*a* is a plan view of the upper leg of the L-shaped member.

FIG. 8*b* is an end view showing schematically an alternative overlapping arrangement.

FIG. 9 is a plan view of an alternative embodiment of this invention.

FIG. 10 is a plan view of a single segment shown in FIG. 9.

FIG. 11 is a section taken along 11—11 of FIG. 9.

FIGS. 12*a* and 12*b* are perspective views of the embodiment shown in FIGS. 9-11 being used with different sized poles.

DESCRIPTION OF THE PREFERRED EMBODIMENTS

Referring to FIG. 1, tree planter 10 is shown mounted on tree trunk 12 supporting a plurality of flower pots 14.

As seen in FIGS. 2-5, tree planter 10 comprises a plurality of identical, arcuate-shaped segments 16*a*-16*h* which are overlapped in a manner to be described.

As more particularly seen in FIG. 3, segment 16*d* is provided with a circular opening 18 to accomodate a pot as shown in FIG. 1, and a pair of curved slots 22*d*. It will be seen that segment 16*e* has a curved slot 24*e* which is directly underneath and aligned with a slot 22*d* in segment 16*d* and that on the other side a segment 16*c* has one of its slots 24*c* aligned with slot 22*d* in segment 16*d*.

As shown by the double headed arrows in FIG. 3, by sliding segments 16*c*, 16*d*, and 16*e* with respect to each other, the opening formed by all of the segments 16*a*-16*h* can be adjusted to the size of tree trunk 12 within a range determined by the length of slots 24*e*, 22*d*, 24*c*, etc.

As seen in FIGS. 4 and 5, bolts 26 with wing nuts 28 can be employed to lock the various segments together once they are adjusted to fit tightly around tree trunk 12. In many cases this tight fit will be adequate to provide support for flower pots 14 and no further buttressing will be required.

It will be apparent from the foregoing description, that by adding segments it is possible to increase the diameter of trunk 14 which can be accommodated, and, conversely, by taking away one or more segments it is possible to fit the arrangement on a tree with a narrower tree trunk.

Under those circumstances where due to the number and weight of the flower pots to be supported is such that additional buttressing is required, the present invention permits the use of a simple device to accomplish this result.

As seen in FIGS. 6–8, a simple L-shaped member 32 may be employed to provide this additional support. The top leg of member 32 would be provided with an elongated slot 34 as seen in FIG. 8*a* through which bolt 26 passes. The bottom leg rests against tree trunk 12 and may be bent slightly toward the trunk to increase its effectiveness. It should be noted that it may not be necessary to provide a member 32 for each bolt 26, as in many situations the use of two or three of these supports may be all that is necessary.

It should also be noted that segments 16*a*–16*h* are illustrated so that one segment is on top and the two adjacent segments are underneath. This can be varied so that, for example, as seen in FIG. 8*b*, the overlapping can be all in one direction, or in fact there can be a mixture or combination of the two types of overlapping.

The present invention can also be used in connection with a mast or pole which is square or rectangular in cross section.

As seen in FIGS. 9–12, planter 40 is made up of four identical, flat, L-shaped segments 42*a*, 42*b*, 42*c*, and 42*d* with openings 44*a*–44*d* to support the flower pots, and elongated straight slots 46*a*–46*d* and 48*a*–48*d* on opposite sides of opening 44*a*–44*d*. It will be seen that segments 42*a*–42*d* are rounded on the outside and have square corners on the inside, as, for example, corner 52*b* in segment 42*b* shown in FIG. 10.

As illustrated in FIG. 11, a bolt 54 with a wing nut 56 would be employed with each pair of overlapping extended slots and the size of the pole opening can be accommodated by moving the segments as shown by the double arrows in FIG. 11.

FIGS. 12*a* and 12*b* show how poles 58 and 62 of different sizes can be accomodated by making the aforementioned adjustments. It will also be seen from this figure, that planter 40 can accomodate rectangular as well as square poles.

The segments making up the planters described above can be made of a variety of materials, such as wood, rigid plastic, metal, etc. They can be made in a variety of colors, thicknesses, and even their outside shapes can be designed for particular application.

It is understood therefore that while only certain preferred embodiments of this invention have been described many variations of this invention are possible without deviating from the principles of this invention as defined in the claims which follow.

What is claimed is:

1. A planter for supporting a plurality of plant pots around the trunk of a tree comprising a plurality of identical, flat segments, each segment having an opening in the middle to support a plant pot and a pair of slots on opposite sides of said opening, said segments overlapping each other with the slots on overlapping segments being aligned with each other and surrounding said trunk, a bolt extending through each pair of aligned slots, and means on each bolt to lock overlapping segments after sliding said overlapping segments with respect to each other to closely fit the outline of said trunk, a plant pot being supported inside each opening in said segments.

2. The planter of claim 1 in which each segment forms the arc of a circle and said slots are arcuate in shape.

3. The planter of claim 2 wherein said segments overlap each other in such a manner that alternate segments are on top and the segments in between are underneath.

4. The planter of claim 1 wherein said segments overlap each other in the same direction.

5. The planter of claim 2 having means attached to at least one of said bolts to buttress said planter against said tree.

6. The planter of claim 5 wherein said buttress means comprises an L-shaped member having an upper leg flush with the underside of a pair of overlapping segments said upper leg having an opening through which said bolt passes and a downwardly extending leg resting against said trunk.

7. The planter of claim 6 wherein the opening in said upper leg is extended along the length of said upper leg to accomodate the opening formed by said planter around said trunk.

8. A planter for supporting a plurality of plant pots around a post of rectangular cross section comprising a plurality of identical, flat segments, each segment consisting of a pair of L-shaped legs, each leg having an opening where said legs come together to support a flower pot and a pair of extended slots on said legs on opposite sides of said opening, said segments overlapping each other with the slots on overlapping segments being aligned with each other with said legs surrounding said post, a bolt extending through each pair of aligned slots, and means on each bolt to lock overlapping segments after sliding said overlapping segments with respect to each other to closely fit the outside of said post, a plant pot being supported inside each opening in said segments.

* * * * *